US005628424A

United States Patent [19]

Gola

[11] Patent Number: 5,628,424

[45] Date of Patent: May 13, 1997

[54] TRASH RECEPTACLE WITH BAG HOLDER

[76] Inventor: Stephen G. Gola, R.R. 3 Box 212A, Coudersport, Pa. 16915

[21] Appl. No.: 585,118

[22] Filed: Jan. 11, 1996

[51] Int. Cl.[6] ..... B65F 1/06

[52] U.S. Cl. ..... 220/407; 220/908

[58] Field of Search ..... 220/407, 404, 220/908

[56] References Cited

U.S. PATENT DOCUMENTS

| | | | |
|---|---|---|---|
| 4,753,367 | 6/1988 | Miller et al. | 220/404 |
| 4,765,579 | 8/1988 | Robbins, III et al. | 220/908 |
| 4,953,740 | 9/1990 | Koda | 220/908 |
| 5,458,259 | 10/1995 | Falk | 220/407 |
| 5,503,292 | 4/1996 | Cuccharia | 220/407 |

FOREIGN PATENT DOCUMENTS

| | | | |
|---|---|---|---|
| 4321750 | 1/1994 | Germany | 220/407 |

*Primary Examiner*—Stephen J. Castellano
*Attorney, Agent, or Firm*—Goldstein & Associates

[57] ABSTRACT

A trash receptacle having base, body and lid portions that are separable from one another. Both the base and body portions have a horizontally oriented bottom panel and a front, a rear and two opposing vertically oriented side walls that extend upwardly from the bottom panel and are attached to one another at right angles. The walls and bottom panel of the base portion together define a bag storage space, and the walls and the bottom panel of the body portion together define a trash storage space. The bottom panel of the body portion provides an opening for accessing the bag storage space of the base portion. The lid portion has a front, a rear and two opposing vertical side walls with an upfacing lip secured to an upfacing edge of the walls. A top panel is hingeably mounted the lip so as to be moveable between an open, vertically upright position and a closed, horizontal position in which the trash storage space of the body portion is completely sealed.

15 Claims, 5 Drawing Sheets

50

313
310
313C
300
313
320
315C
315B
260
250
250
215C
240
200
215B
210
115C
213
100
132
12
115B
113
150
140
130

TRASH RECEPTACLE WITH BAG HOLDER

BACKGROUND OF THE INVENTION

1. Field of the Invention

The invention relates to a trash receptacle. More particularly, the invention relates to a three-part snap together trash receptacle having a base portion designed to store a plurality of trash bags, a body portion designed to store a single trash bag full of trash in such a way as to allow the full bag to be easily removed from the body portion, and a lid portion that seals the body portion closed.

2. Background and Related Art

There are numerous problems associated with standard household trash receptacles that have made trash storage and removal a dreaded task. Perhaps the most frustrating task is attempting to remove a full bag from the receptacle. This is often rather difficult because the trash stored in the bag tends to bulge against the walls of the trash receptacle, thus making it difficult to remove. In addition, as the bag is filled up, air is often trapped between the bag and the receptacle walls. This causes a vacuum effect that makes it even more difficult to remove the full bag. Because a full bag is so difficult to remove, when the bag is pulled straight upward, the entire receptacle often lifts up with the bag rather than the bag lifting out of the receptacle. Therefore, the user must often call on the assistance of another person to hold the receptacle steady, or else the user must squeeze the receptacle between the knees while pulling the bag out.

Another problem with conventional style trash receptacles is that they do not force trash to be compacted within the receptacle. Therefore, when the full bag is removed, the user must attempt to shake the trash further down into the bag and compact it so that the bag may be tied shut.

Yet another drawback is that twist ties or other such fastening means are not provided with the receptacle, thus forcing the user to search for a tie each time a bag is removed. Still further, once the full bag of trash has been removed from the receptacle, the user must also locate a new bag to put in the receptacle.

Unfortunately, even properly positioning a new bag within conventional trash bags is often difficult because the walls of the empty bag tend to cling together in the center of the receptacle rather than fitting against the walls and bottom of the receptacle. This is especially undesirable as the bag begins to be filled, as air becomes trapped between the wall of the container and the bag. This prevents the bag from being completely filled, and makes it difficult to remove the bag from the receptacle once it is filled with trash.

To date, very few solutions have been proposed for remedying these problems associated with trash receptacles. Rather, it seems that more attention has been giving to improving the design of trash bags instead of that of trash receptacles. For instance, one such improvement includes the implementation of an integral pull-tie means around the upper edge of the trash bags so as to allow bags to simply be pulled closed when full rather than forcing the user to search for a fastener. While this and other such improvements may solve some of the above described problems, no prior art trash receptacles have been designed to solve the above described difficulties associated with conventional trash receptacles.

Thus there is a clear need for an improved trash receptacle device that remedies the above described problems. Such a device would contain up to an abundant supply of ties and bags, and would present the bags in a way that automatically dispenses a new bag in place once the full bag is removed. Such a device would also be designed specifically to ensure that the bag fills in a compact manner, and would also make it extremely easy to remove full bags. The present invention provides these and other such advantages as further detailed in the following Summary of the Invention.

SUMMARY OF THE INVENTION

The present invention is an improved trash receptacle having a base, a body and a lid portion. Both the base and body portions each have a horizontally oriented bottom panel and front, rear and two vertically oriented side walls that extend upwardly from the bottom panel and are attached to one another at right angles. The walls and bottom panel of the base portion together define a bag storage space, and the walls and the bottom panel of the body portion together define a trash storage space. The lid portion has a front, rear and two opposing vertical side walls with an upfacing lip secured to and extending outwardly from an upfacing edge of the walls. A top panel is hingeably mounted to the lip so as to be moveable between an open, vertically upright position and a closed, horizontal position in which the trash storage space of the body portion is completely sealed.

Preferably, the base, body and lid portions are constructed as independent units that can be snapped in and out of attachment with one another. Thus it is an object of the present invention to provide an improved trash receptacle that can be easily color coordinated and changed in appearance by simply replacing one or more of the portions with a new portion of a different color. It is another object of the invention to significantly reduce repair and replacement costs associated with the receptacle, as each portion can be replaced as needed rather than necessitating the replacement of the entire receptacle.

It is an object of the invention to provide a trash receptacle that stores a large quantity of trash bags within the receptacle so that a new bag is readily accessible each time a full bag is removed from the receptacle. It is another object of the invention to provide ample storage space for approximately a one year's supply of bags.

It is another object of the invention to have a construction that allows either a roll of pre-attached, perforated bags or a box of individual bags to be positioned in the bag storage space of the base portion. When a roll of perforated bags is used, a new bag is automatically dispensed when the full bag is lifted from the receptacle. The user must simply tear the new bag from the bottom of the full bag and place the bag around the lip of the lid portion. When a box of individual bags are used, the user simply reaches down and pulls the bag up to lip.

It is a primary object of the present invention to provide a receptacle from which it is extremely easy to remove a full bag. This is accomplished by the placement of ventilating slots in the base and body portion of the receptacle so that the air is not trapped between the bag and the body's walls. It is an additional object of the invention to provide a configuration that actually forces trash to naturally compact as it is placed in the bag because when trash is placed into the bag, any air between the bag and the receptacle walls is forced out of the receptacle through the ventilation slots, thus compacting the trash and giving the bag more area to expand within the body portion. Consequently, the present invention allows a single bag to hold more trash. In fact, the present inventive configuration is so effective in compacting trash that it is preferably less voluminous than standard receptacles because otherwise bags tend to become too full.

It is yet another object to provide a spine in the body portion that also aides in the easy removal of the full bag. The spine protrudes into the trash storage space of the body portion and causes a natural air gap to form between the receptacle wall and the bag, thus allowing the bag to glide out of the container with much less resistance. It is an additional object of the invention to provide a spine that gives rigidity to the container so as to reduce or prevent the container from bulging as it gets filled with trash.

It is another object of the invention to provide a lid portion having a configuration that does not require the lid to be removed from the receptacle in order to remove a full bag from the receptacle. When the bag is being accessed, the lid remains in an upright, vertical position.

It is yet another object of the present invention to provide a bag tie storage means on the receptacle away from the trash.

It is still further another object of the present invention to provide a flange on which the user may plant the feet so that the receptacle remains in place when the bag is pulled upwardly out of the receptacle. This is additionally very useful for the handicap, elderly, injured or any others suffering a loss of strength.

It is another object to construct the bottom panel of the body portion so that it sloped downwardly from a centrally located slot to the walls of the body, thus ensuring that any liquids that enter the body will remain near the walls and cannot seep into contact with the stored bags in the base portion.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
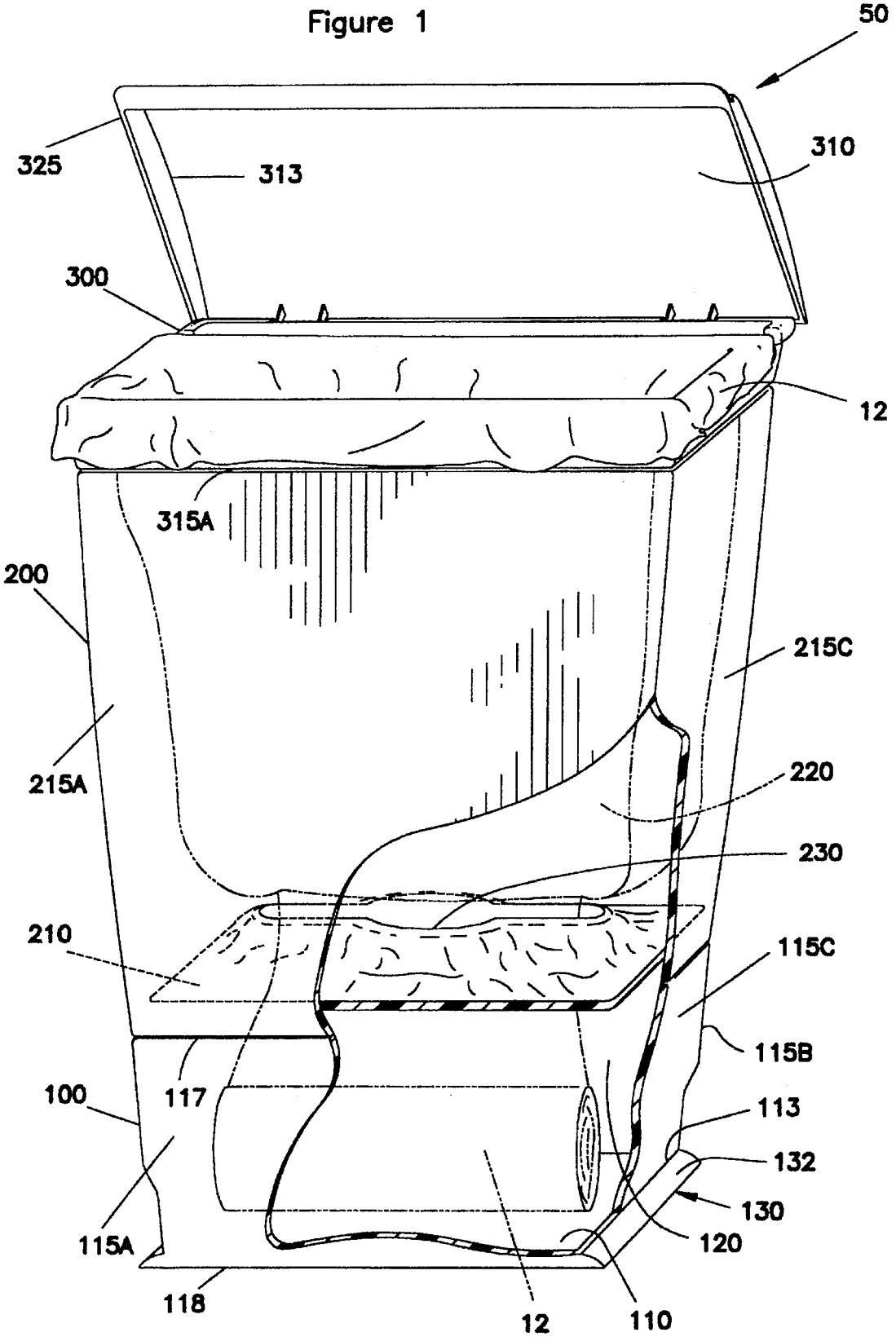
FIG. 1 is a perspective view of the invention, illustrating the placement of a roll of bags in a bag storage space, and a single bag positioned in a trash storage space.
Figure 2:
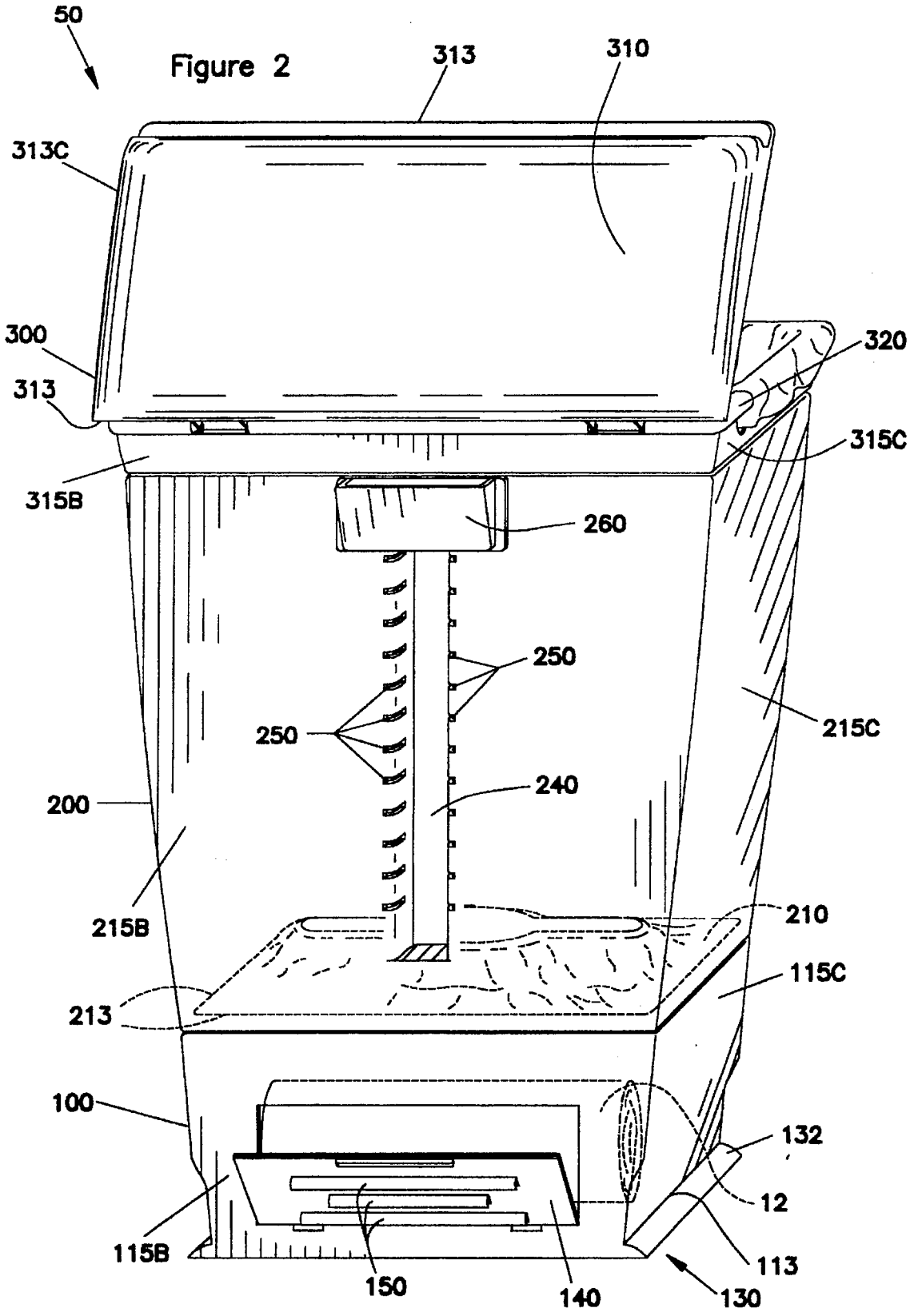
FIG. 2 is an perspective view of the invention, illustrating the positioning of a door in a base portion of the invention, and a spine and bag-tie storage means in a body portion of the invention.
Figure 3:
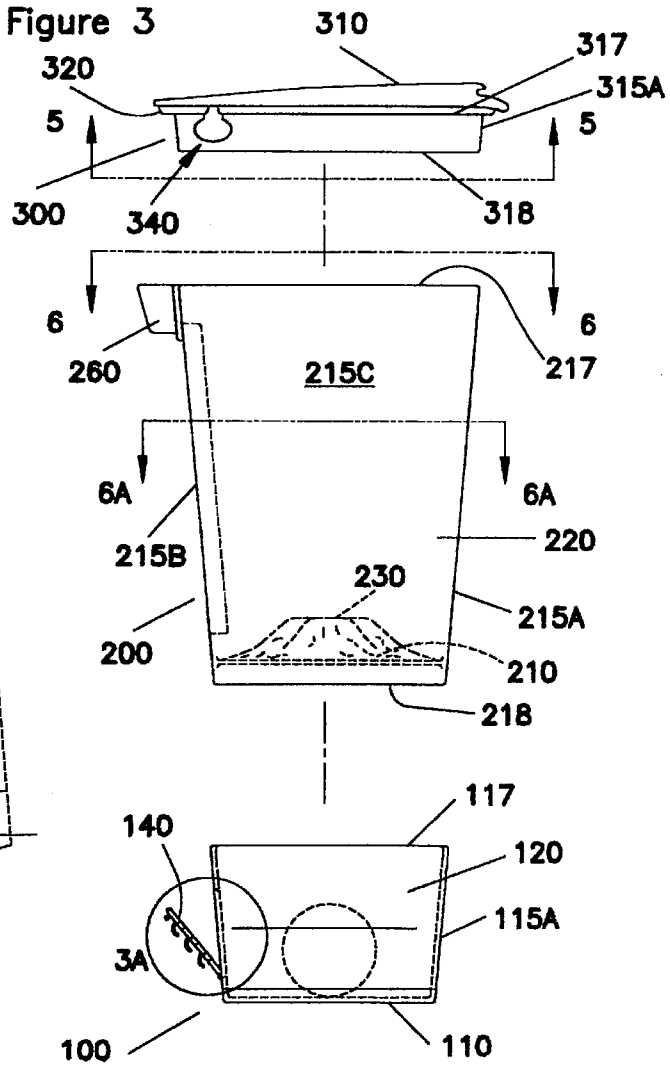
FIG. 3 is a side elevational view of the invention, particularly illustrating the base, body and lid portions disengaged from one another, and also illustrating the upward slope of a bottom panel of the body portion.
Figure 3A:
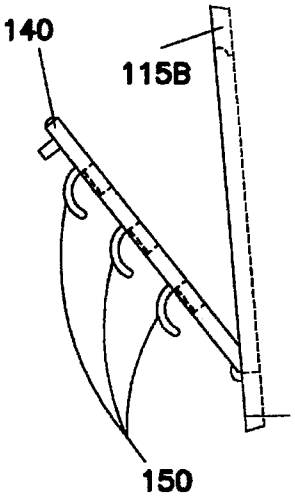
FIG. 3A is an exploded elevational view of the invention, particularly illustrating the placement of louvers on the door of the base portion.

FIGS. 1–6A illustrate the present inventive trash receptacle 50 designed to eliminate many problems commonly incurred through the use of ordinary trash receptacles. Referring particularly to FIG. 1–3, the present trash receptacle comprises a base portion 100, a body portion 200 and a lid portion 300. Preferably, the base 100, body 200 and lid 300 are constructed as individual units that are separable from one another, as best illustrated in FIG. 3, by simply snapping and unsnapping them together. When the portions 100, 200 and 300 are snapped together, the receptacle 50 preferably has a generally rectangular shape that gradually tapers outwardly from the base 100 to the lid 300.

FIGS. 1 and 2 illustrate the base unit 100 having a planar, rectangular bottom panel 110 having four bottom edges 113. The base 100 also has a front 115A, a rear 115B and two opposing vertically oriented side walls 115C that extend upwardly from the bottom edges 113 of the bottom panel 110. The walls 115A, 115B and 115C are attached to one another and meet at approximately right angles and provide a counties upfacing edge 117. The walls 115A, 115B and 115C and the bottom panel 110 together define a trash bag storage space 120 in which a plurality of trash bags 12 can be easily stored. The bag storage space 120 is great enough in size to accommodate either a roll of interconnected bags separable by perforations or a box of individual bags. The base 100 also provides a foot accommodating means 130. In one preferred embodiment, illustrated in FIGS. 1 and 2, the foot accommodating means 130 comprises a flange 132 that extends outwardly from the bottom edges 113 of the bottom panel 110 around the entire base 100. A door 140 is positioned in the rear wall 115B to allow access to the bag storage space 120. One or more louvers 150 are preferably positioned in the door 140 to allow for ventilation of the base portion 100 while still providing the necessary rigidity to the door 140.

Figure 4:
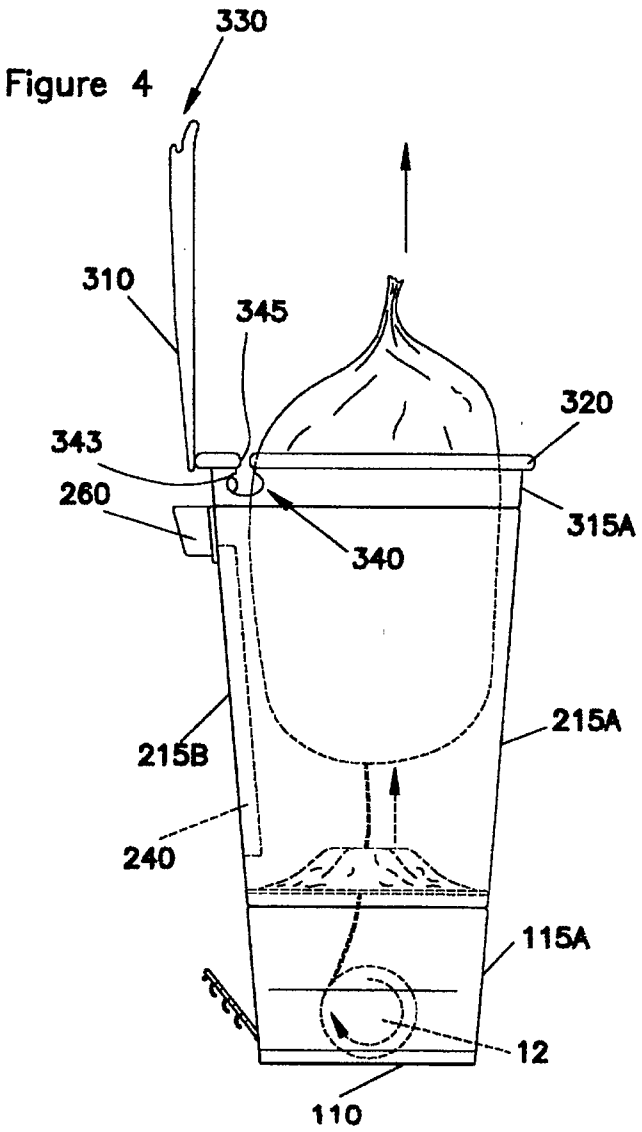
FIG. 4 is a side elevational view of the invention, particularly illustrating a full bag of trash being removed from the trash storage space and a new bag being dispensed from the bag storage space into the trash storage space.
Figure 6:
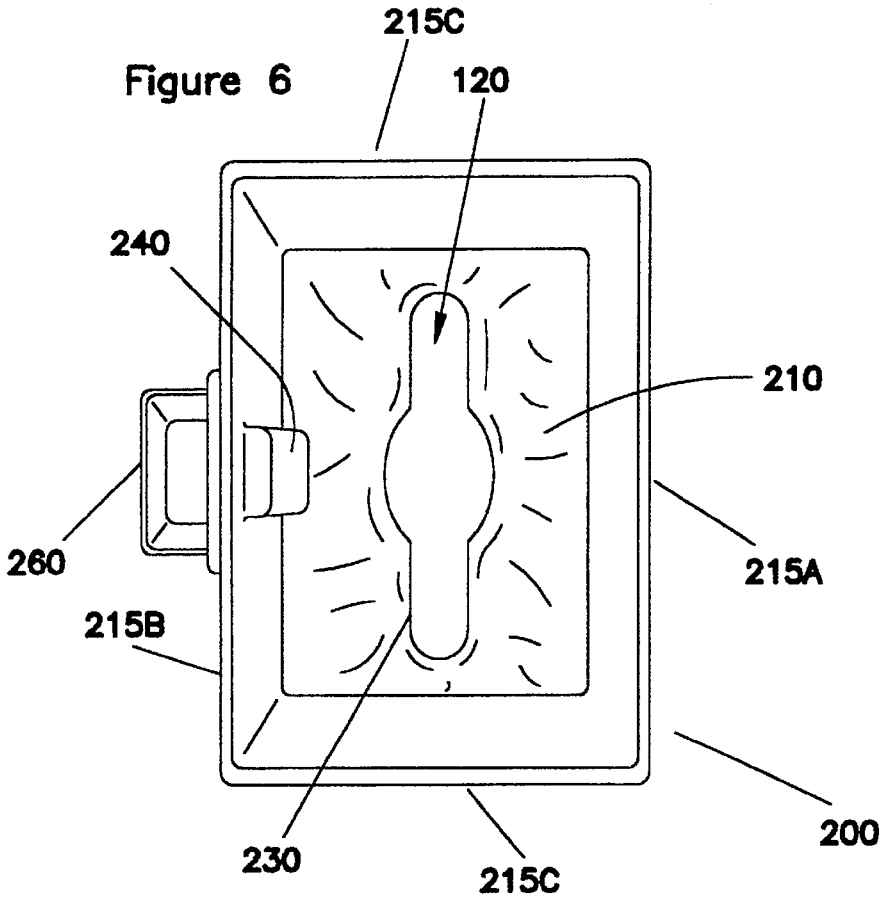
FIG. 6 is a bottom plan view of the body portion of the invention, particularly showing the positioning of a spine and a bag-tie storage space.
Figure 6A:
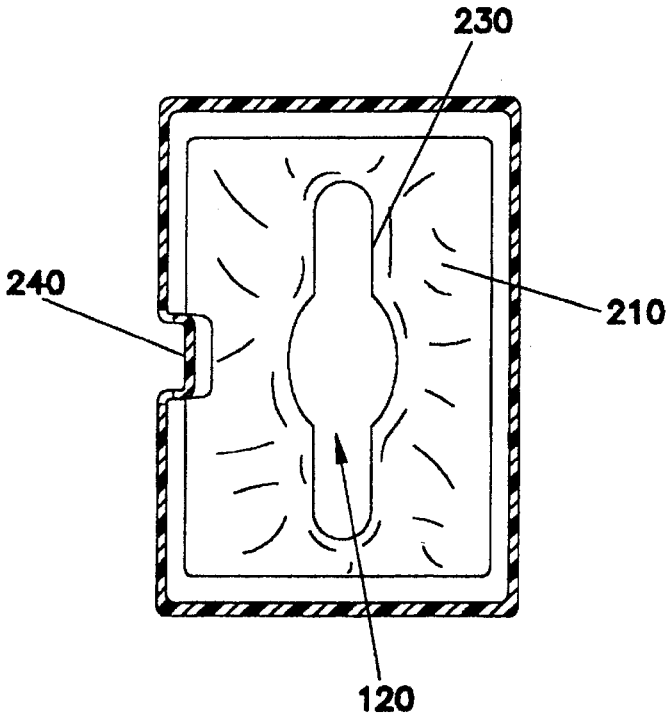
FIG. 6A is a cross sectional view of the body portion of the invention taken along cutting line 6A—6A of FIG. 3, particularly showing the sloped bottom panel having an opening for providing access to the bag storage space.

FIGS. 1 and 2 illustrate the body portion 200 of the receptacle 50 which also has a generally rectangular bottom panel 210 providing four bottom edges 213 from which a front 215A, a rear 215B and two opposing approximately vertical side walls 215C upwardly extend. The walls are attached to one another and meet at approximately right angles, the walls 115A, 115B and 115C providing a continuous upfacing edge 117 and a continuous downfacing edge 118, the downfacing edge 118 preferably extends slightly below the intersection with the bottom panel 210, as best seen in FIGS. 3 and 4. The body's walls 215A, 215B and 215C and the bottom panel 210 together define a trash storage space 220 in which a bag 12 of trash may be stored. When the receptacle 50 is designed as three separable units, the downfacing edge 218 of the body 200 is designed to snap into engagement with the upfacing edge 117 of the base 100 so that the front 115A, rear 115B and side walls 115C of the body 100 are aligned with the corresponding base walls 215A, 215B and 215C. When the body 200 and base 100 are engaged with one another, the bottom panel 210 of the body 100 covers the bag storage space 120 in the base 100. The bottom panel 210 of the body 200 provides an opening 230 through which to access the bags 12 stored in the bag storage space 120 of the base 100. As illustrated in FIGS. 6 and 6A, the opening 230 is slightly longer than a width of trash bags 12 and preferably a central portion of the opening 230 is flared wide enough to allow a hand of the user to be placed through the opening 230 to access the bags 12.

As best seen in FIGS. 3 and 4, the bottom panel 210 of the body 200 gradually slopes upwardly from the body's walls 215A, 215B and 215C to the opening 230. This ensures that liquids that enter the body 200 will not seep through the opening 230 and into contact with the bags 12 in the bag storage space 120 of the base 100 below, but rather all liquids will automatically flow away from the opening 230 towards the body's walls, as the lowest point of the bottom panel 210 is adjacent to each of the walls 215A, 215B and 215C.

FIGS. 3 and 4 also illustrate a rigid spine member 240 positioned vertically along the length of the body's rear wall 215B. The spine 240 preferably extends from approximately two inches below the upfacing edge 217 to two inches above the downfacing surface 218. As clearly seen in FIGS. 6 and 6A, the spine 240 protrudes inwardly from the rear wall 215B into the trash storage space 220, adding rigidity to the body 200 and preventing it from bulging under the force of the enclosed trash. Preferably, the spine 240 has a generally rectangular shape. As seen in FIG. 2, a series of ventilation slots 250 are preferably provided on each side of the spine 240 to allow air to escape from the receptacle 50 as trash is added to the bag 12. A bag-tie storage means 260 is positioned along the body's rear wall 215B so as to provide storage for trash bag ties in an easily accessible manner.

Figure 5:
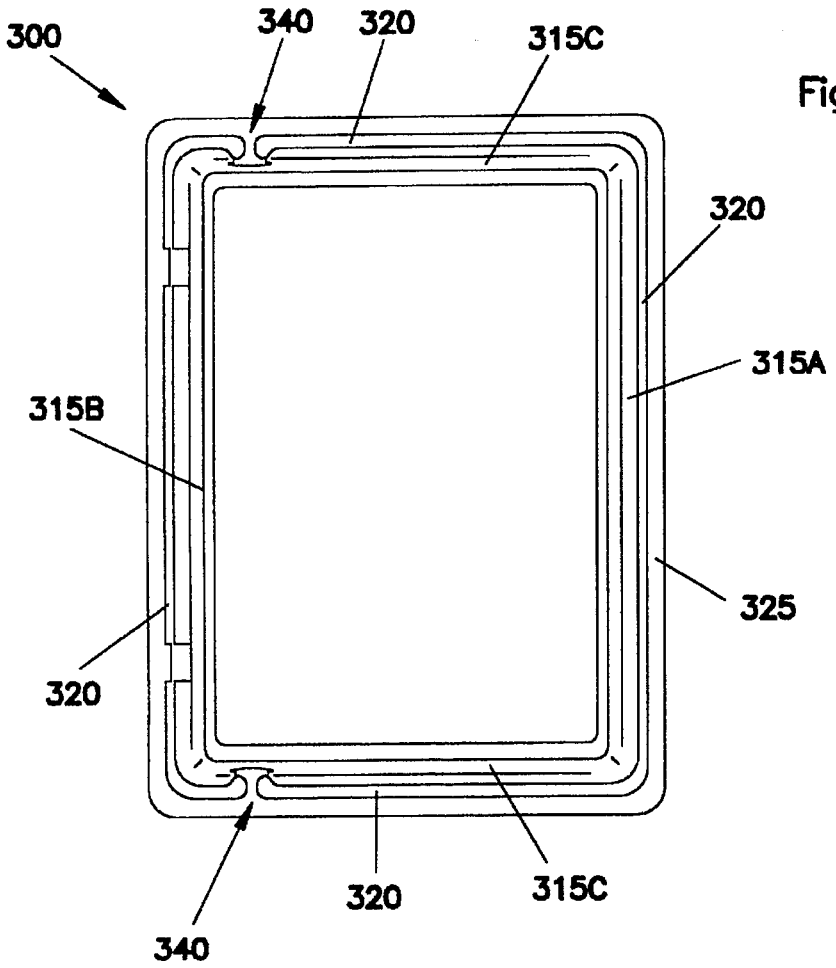
FIG. 5 is a bottom plan view of the lid portion of the invention, particularly showing a downfacing lip of a top panel engaged over an upfacing lip so as to seal the trash storage space closed.

As illustrated in FIGS. 1 and 2, the lid portion 300 of the receptacle 50 has a front 315A, a rear 315B and two opposing approximately vertical side walls 315C attached to each other at right angles. As seen in FIG. 3, the walls provide an upfacing edge 317 and a downfacing edge 318. When the base 100, body 200 and lid portions 300 are constructed as independent units, the downfacing edge 318 is designed to snap into engagement with the upfacing edge 217 of the body 200. An upfacing lip 320 is secured to and extends outwardly from the upfacing edge 317 of the walls 315A, 315B and 315C. The lid portion 300 also provides a rectangular top panel 310 having four top edges 313. A downfacing lip 325 is secured to and extends downwardly from the top edges 313, as most clearly seen in FIG. 1. The downfacing lip 325 is designed to engage with and fit securely around the upfacing lip 320, as best seen in FIG. 5. The downfacing lip 325 of the top panel 310 is hingeably mounted to the upfacing lip 320 along the rear wall 315B. In one preferred embodiment, a C-shaped clamp is provided on the downfacing lip 325, and horizontal mounting bar is positioned on the upfacing lip 320, the mounting bar snapping firmly into engagement with the C-shaped clamp to mount the top panel 310 to the rear wall 315B of the lid portion 300. However, there are many other ways well known in the art by which to hingeably mount the top panel 310, and, as such, the mounting procedure is not further detailed herein.

Figure 5A:
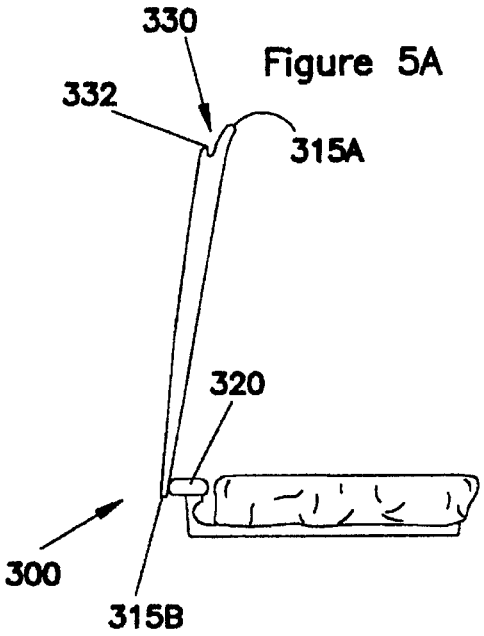
FIG. 5A is a side elevational view of the lid portion of the invention, particularly showing the trash bag secured in a bag retention means and positioned around the upfacing lip.
Figure 5B:
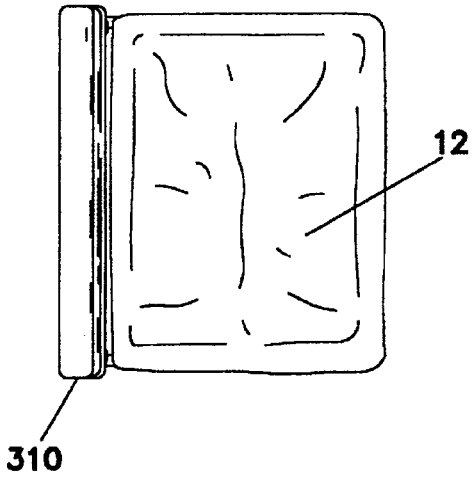
FIG. 5B is a top plan view of the lid portion of the invention, particularly showing the top panel in a vertical, open position.

The top panel 310 is pivotable between a horizontal, closed position, illustrated in FIG. 3, and a vertical, open position, illustrated in FIGS. 4 and 5B. In the closed position, the top panel 310 effectively seals the trash storage space 220 of the body 200 closed. As best seen in FIGS. 3, 4 and 5A, a gripping means 330 is provided in the top panel 310 near the front wall 315A so as to allow the top panel 310 to be easily manually moved between the open and closed positions. Preferably, the gripping means 330 comprises an overhang 332 provided in the top panel 310 under which to place fingers.

FIG. 4 illustrates a bag retention means 340. The bag retention means 340 comprises a circular opening 343 positioned in each of the opposing side walls 315C directly below the upfacing lip 320 near the rear wall 315B of the lid portion 300. A slot 345 extends completely through the upfacing lip 320 directly above the opening 343 so as to provide access to the opening 343. As seen in FIG. 5A, the bag retention means 340 is designed to retain a bag 12 around the upfacing lip 320 in such a way that the bag 12 can be removed from the receptacle 50 without removing the top panel 310 from the lid portion 300.

Thus, to use the present inventive trash receptacle 50, the base, body and lid portions, 100, 200 and 300 respectively, are snapped into engagement with one another as above detailed. A plurality of bags 12 are positioned in the bag storage space 120 of the base 100, and one bag is pulled through the opening 230 in the bottom panel 210 of the body 200, engaged in the bag retention means 340 and is secured around the upfacing lip 320 of the lid portion 300. To place trash in the bag 12, the top panel 310 of the lid portion 300 is simply moved into the open position, as illustrated in FIG. 5B. When the trash bag 12 is full of trash, it is simply pulled upwardly out of the trash storage space 220 of the body 200. When a roll of perforated bags is positioned in the bag storage space 120, as seen in FIG. 4, as the full bag of trash is lifted out of the storage space 220, the next bag in the roll is pulled through the opening 230 and the trash storage space 220. It can then simply be torn from the full bag, engaged with the bag retention means 340 and positioned around the lip 320.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A trash receptacle with bag holder for storing a plurality of trash bags, trash bag ties and trash, the receptacle comprising:

a base portion having a horizontally oriented bottom panel, the bottom panel is rectangular in shape having four bottom edges, the base portion having a front, a rear and two opposing side walls which extend vertically upwardly from the bottom edges, the side walls attached to each other at right angles and providing an upfacing edge, the walls and the bottom panel together defining a storage space for storing the trash bags;

a body portion having a horizontally oriented bottom panel, said bottom panel of the body portion is rectangular in shape having four bottom edges, the bottom panel of the body portion further having a front, a rear and two opposing side walls which extend vertically upwardly from the bottom edges of the body portion, the side walls of the body portion attached to each other at right angles and each providing an upfacing edge and a downfacing edge, the walls and the bottom panel together defining a storage space for storing trash; and a lid portion having a front, a rear and two opposing vertically oriented side walls, the walls attached to each other at right angles and providing an upfacing and a downfacing edge, the lid portion having an upfacing lip extending outwardly from the upfacing edge of the side walls, the lid further including a top panel having four top edges with a downfacing lip extending downwardly therefrom, the downfacing lip of the top panel hingeably mounted to the upfacing lip along the rear wall of the lid portion, the top panel pivotable between a vertical, open position for allowing access to the storage space of the body, and a horizontal, closed position for sealing the storage space of the body portion.

2. The trash receptacle as recited in claim 1, wherein the base, body and lid portions are constructed as independent, separable units engageable with one another, the upfacing edge of the base portion engaging with the downfacing edge of the body portion and the upfacing edge of the body portion engaging with the downfacing edge of the lid portion.

3. The trash receptacle as recited in claim 1, the base portion further including a door in the rear wall for allowing access to the bag storage space.

4. The trash receptacle as recited in claim 3, the door further including one or more louvers for allowing air to flow through the base portion.

5. The trash receptacle as recited in claim 1, the base portion further including a foot accommodating means.

6. The trash receptacle as recited in claim 5, wherein the foot accommodating means comprises a flange extending outwardly from the bottom edges of the bottom panel of the base portion.

7. The trash receptacle as recited in claim 1, the body portion further including a vertically oriented spine positioned in the rear wall, the spine protruding inwardly from the rear wall into the trash storage space.

8. The trash receptacle as recited in claim 7, wherein a plurality of ventilation slots are positioned along each side of the spine.

9. The trash receptacle as recited in claim 1, the bottom panel of the body further including an opening through which to access trash bags in the bag storage space of the base portion.

10. The trash receptacle as recited in claim 9, wherein the bottom panel is upwardly sloped from the body's walls to the opening.

11. The trash receptacle as recited in claim 1, the body portion further including a bag-tie storage means mounted to the rear wall for retaining a plurality of bag ties in an easily accessible location.

12. The trash receptacle as recited in claim 1, the lid portion further including a bag retention means.

13. The trash receptacle as recited in claim 10, the bag retention means comprising a circular opening in each of the two opposing side walls of the lid portion and a slot extending through the upfacing lip and to the opening so as to provide access to the opening.

14. The trash receptacle of claim 1, the top panel of the lid portion further including a gripping means by which to grip the top panel and move it between the open and closed positions.

15. The trash receptacle of claim 12, wherein the gripping means comprises an overhang positioned in the top panel near the front wall of the lid portion.

* * * * *